United States Patent [19]

Martin

[11] 4,228,708

[45] Oct. 21, 1980

[54] PORTABLE SAWMILL

[76] Inventor: Peter B. Martin, P.O. Box 194, Superior, Mont. 59872

[21] Appl. No.: 931,308

[22] Filed: Aug. 7, 1978

[51] Int. Cl.[2] ..... B27B 7/02; B27B 7/04

[52] U.S. Cl. ..... 83/404.1; 83/102.1; 83/928; 83/112; 144/312; 83/425.4

[58] Field of Search ..... 83/404.1, 404, 928, 83/102, 112, 425.2, 425.3, 425.4, 435.2; 144/312

[56] References Cited

U.S. PATENT DOCUMENTS

| | | | |
|---|---|---|---|
| 212,713 | 2/1879 | Little | 83/404.1 |
| 589,793 | 9/1897 | Proctor et al. | 83/102.1 |
| 1,574,423 | 2/1926 | Hagmaier | 83/102.1 |
| 1,874,519 | 8/1932 | Haubrock | 83/928 |
| 2,574,974 | 11/1951 | Johnson | 83/112 |
| 3,742,796 | 7/1973 | McMillan | 83/102.1 |
| 3,828,635 | 8/1974 | Smith | 83/102.1 |
| 4,148,344 | 4/1979 | Critchell | 83/471.2 |

*Primary Examiner*—Donald R. Schran
*Attorney, Agent, or Firm*—Arthur L. Urban

[57] ABSTRACT

A portable sawmill including a log positioning section, a log sawing section and a drive for the log positioning section and the log sawing section; the log positioning section including a supporting frame with an inclined face and a conveyor disposed along the inclined face; the log sawing section including a substantially flat log bed, a first conveyor for moving logs along the bed, a first saw assembly including at least two saw blades rotatably mounted on a common horizontal drive shaft disposed below the log bed, means for adjusting the spacing between the saw blades, at least two vertically disposed guides positioned adjacent the delivery area of the saw blades, and means for adjusting the spacing between the guides, a second saw assembly including a plurality of saw blades rotatably mounted on a common vertical drive shaft disposed adjacent to the log bed, a second conveyor located adjacent the delivery area of the plurality of saw blades, and the drive including controls for independently actuating the conveyor of the log positioning section and the first and second conveyors of the log sawing section.

10 Claims, 5 Drawing Figures

PORTABLE SAWMILL

This invention relates to a novel sawmill and more particularly relates to a new sawmill which can be transported to a logging site.

It is customary in logging operations to haul the logs on trucks to a sawmill. This manner of operation is inefficient because only a portion can be converted to useable lumber with the remainder being waste. As a result, the cost of hauling the logs to the sawmill must be borne by the saleable lumber rather than by the entire load of logs.

The use of portable sawmills has been proposed as a way of increasing efficiency by reducing hauling costs. Since the portable sawmill can operate at the logging site, only useable lumber is hauled from the site. Also, the lumber can be loaded more compactly so more lumber can be transported on each load than could be with logs.

One of the drawbacks both of conventional and portable sawmills is the limited sizes of logs that can be accommodated. Most mills are designed to handle logs within a narrow size range of log diameter and of length. This can present serious problems for the logger since he is required to find other outlets for logs which do not meet sawmill specifications and usually at a greatly reduced price. Also, the design of some sawmills requires that each log be passed through the mill several times to complete the sawing operation. This greatly reduces the productive capacity of a mill.

Other sawmills have limitations on the sizes of lumber which can be produced. In addition, some of the mills require considerable manpower to operate the mill. Further, while sawmills may be advertised as being portable, in fact, they are very difficult to transport to a logging site and very time-consuming to setup for operation. Also, many portable sawmills lack the features and conveniences of permanent mills.

The present invention provides a novel sawmill which can be transported to a logging site and setup for operation simply and conveniently. Furthermore, the sawmill of the invention can utilize logs of widely varying diameters and lengths. In addition, the sawmill permits the logs to be sawed into lumber having a variety of sizes. Moreover, the sawmill can complete all of the log sawing operations in a single pass.

Another advantage of the sawmill of the invention is the positive control of the movement of the logs through the mill. This enables one person to operate the mill without assistance. Further, the operator can make adjustments of the mill to produce different sizes of lumber from his normal work station. Also, the sawmill is simple in design and can be fabricated from commercially available components.

Other benefits and advantages of the novel sawmill of the present invention will be apparent from the following description and the accompanying drawings in which.

Figure 1:
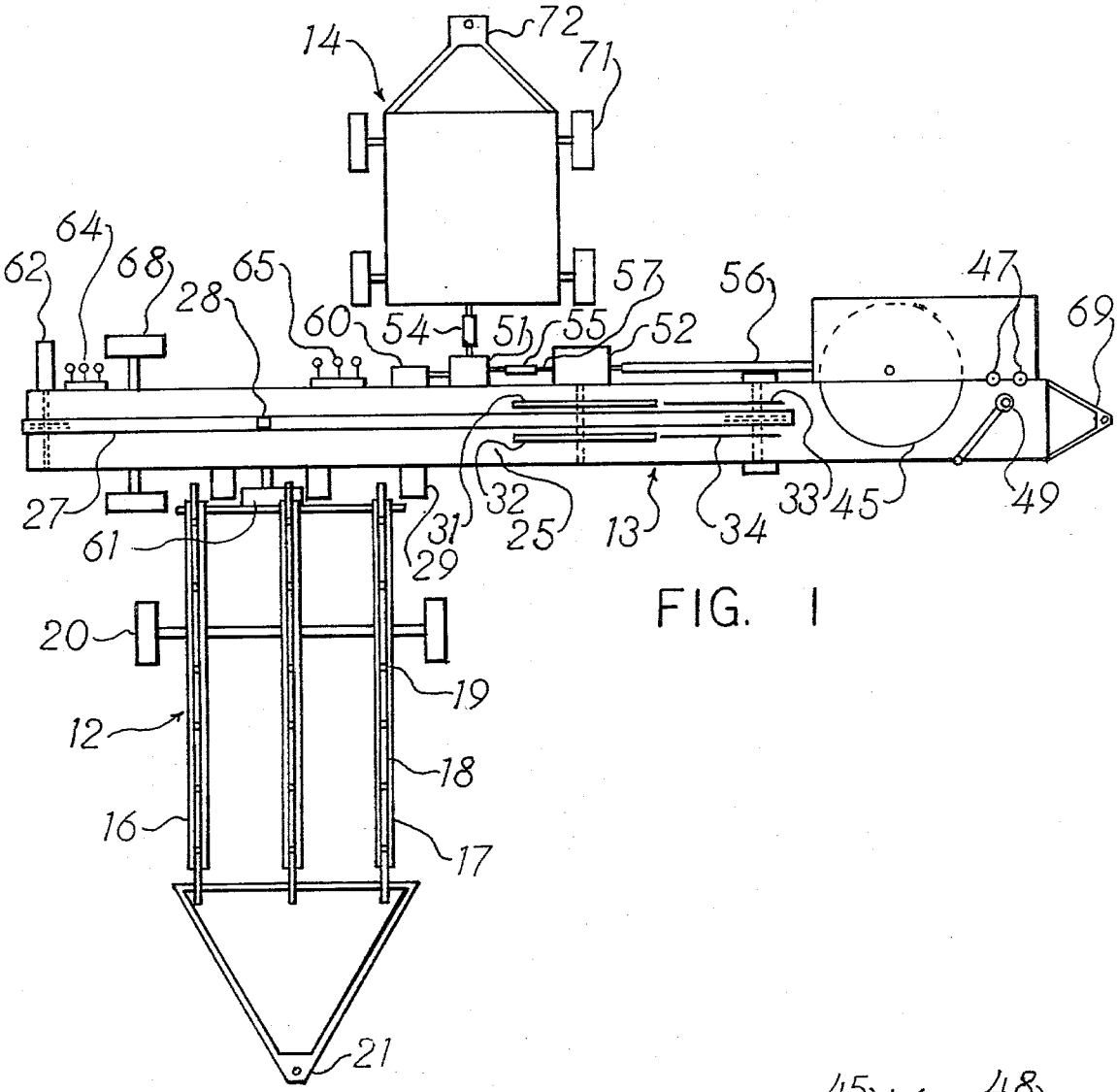
FIG. 1 is a top view of one form of the sawmill of the invention.
Figure 2:
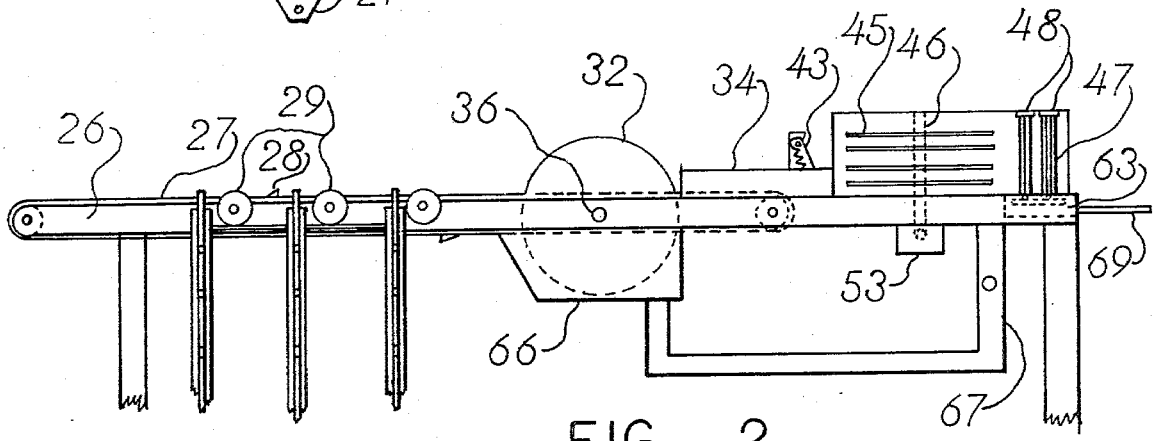
FIG. 2 is a side elevation partially in section of the sawmill shown in FIG. 1.
Figure 3:
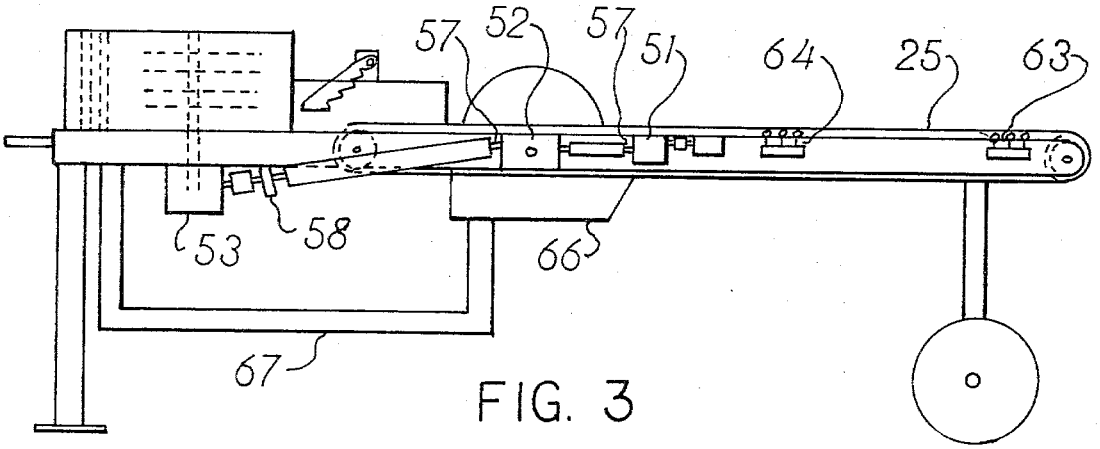
FIG. 3 is a side elevation partially in section of the sawmill shown in FIG. 1 taken from the opposite side from that of FIG. 2.
Figure 4:
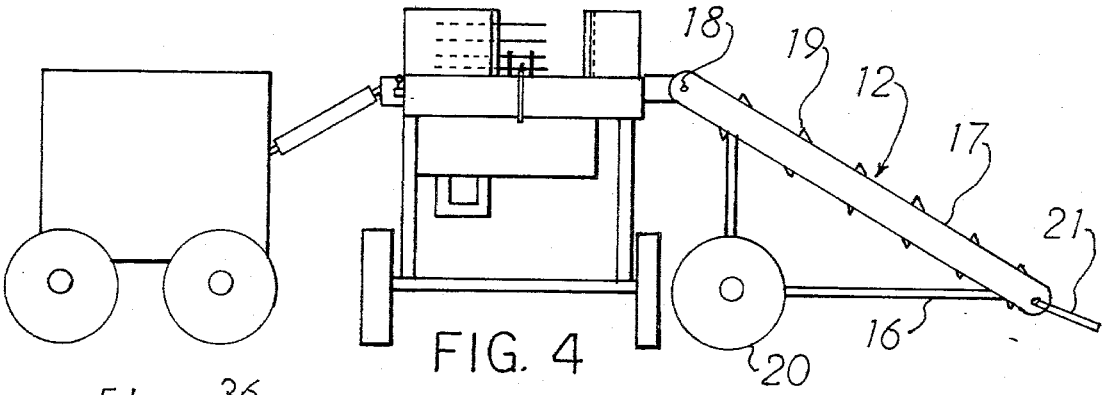
FIG. 4 is a left end view of the sawmill shown in FIG. 1.

As shown in the drawings, one form of the novel sawmill of the present invention includes three principal sections—a log positioning section 12, a log sawing section 13 and a drive or power source 14 for the log positioning and sawing sections. Each of the three sections is separable from the others and is independently supported on its own wheeled carrier. Thus, each section is towed to the logging site and there assembled to form the sawmill of the invention.

The log positioning section 12 includes a supporting frame 16 with an inclined face 17 along which is disposed a multiple chain conveyor 18. The chains making up conveyor 18 have log-engaging projections or dogs 19 to move the logs up the incline. Conveyor 18 is connected to power source or engine 14 through a hydraulic fluid system which will be described hereinafter. Supporting frame 16 is carried by an axle and wheels 20 that are located at one end of the frame. A hitch 21 extends from the end of frame 16 opposite to the end on which the axle and wheeels are mounted. Thus, the log positioning section 12 can be separated from the other sections and transported to a log-ging site by towing it behind a truck or other vehicle.

Log sawing section 13 includes a substantially horizontal log bed 25 carried by a frame 26. Log bed 25 has a central longitudinal slot with a chain coveyor 27. Conveyor 27 has log-engaging dogs 28. Rollers 29 are rotatably mounted on shafts extending from the side of frame 26 toward conveyor 18.

Figure 5:
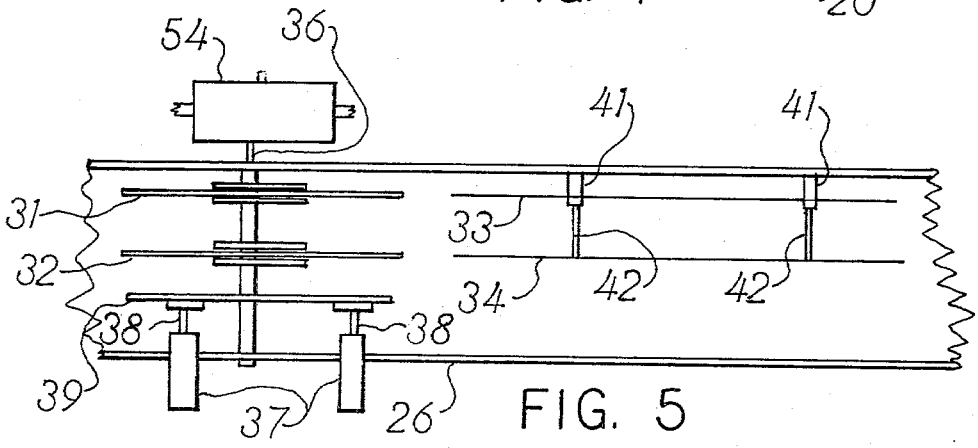
FIG. 5 is an enlarged fragmentary top view of the first saw assembly and guide means of the sawmill shown in FIG. 1.

A first saw assembly is disposed along the log bed 25 in the direction of log movement therealong. The first saw assembly includes at least two cant saw blades 31 and 32 extending upwardly through slots in the log bed 25. Guides shown as vertical splitter guides 33 and 34 are positioned adjacent the delivery area of the saw blades 31 and 32. Saw blade 32 and guide 34 are independently movable to change the spacing between the saw blades and also that between the guides for the cutting of different size lumber. As shown in FIG. 5, the position of saw blade 31 is fixed on shaft 36 while that of saw blade 32 can be changed by actuating hydraulic cylinders 37 to move pistons 38, yoke 39 and blade 32. Similarly, actuation of cylinders 41 moves pistons 42 and guide 34 attached thereto. An anti-kickback arm 43 is pivotally suspended between the delivery portions of guides 33 and 34 to maintain the movement of a log in a forward direction as it contacts the second saw assembly.

The second saw assembly includes a plurality of horizontally disposed saw blades 45 rotatably mounted on a common vertical arbor shaft 46. Shaft 46 is positioned adjacent to the log bed 25 with the blades 45 overhanging the bed. The cut lumber is moved from the saw blades 45 by one or more driven outfeed rolls rotatably mounted on vertical shafts adjacent to the log bed 25. As shown, a pair of outfeed rolls 47 mounted on shafts 48 have gripping surfaces to advance the lumber along the bed 25. A companion pressure roll 49 is positioned adjacent to and biased toward outfeed rolls 47 to maximize movement of the lumber by the rolls.

Engine 14 drives the various elements of the sawmill through a direct drive system and a hydraulic system. The direct drive system includes right angle gear boxes 51, 52 and 53 which are interconnected by drive lines 54, 55 and 56 through universal joints 57 and carrier bearing 58.

The hydraulic system includes a hydraulic pump 60 that is driven by engine 14 through the direct drive system. Pump 60 in turn drives hydraulic motors 61 and 62 which drive chain conveyors 18 and 27 of the log positioning section 12 and the log sawing section 13, respectively. Pump 60 also drives hydraulic motor 63 that drives outfeed rolls 47. The hydraulic system also includes cylinders 37, 38, 41 and 42. Cylinders 37 and 38 change the position of saw blade 32 with respect to blade 31, while cylinders 41 and 42 change the position of splitter guide 34 with respect to guide 33. Hydraulic control valves 64 and 65 are arranged along the frame 26 of the log sawing section 13. Valves 64 are duplicates of valves 65 so the operator will have control valves within reach whether he is working with short logs or long ones. Valves 64 and 65 control the hydraulic motors 61, 62 and 63 as well as cylinders 37,38, 41 and 42.

An exhaust sawdust collection system includes a hood 66 around saw blades 31 and 32 and a manifold 67 adjacent to saw blades 45. The log sawing section 13 is supported on a carrier with an axle and wheels 68 near one end of frame 26 and a hitch 69 at the opposite end. Similarly, engine 14 is disposed on a carrier having axles and wheels 71 and a hitch 72.

In the use of the novel sawmill of the present invention shown in the drawings, the three independent sections, namely, the log positioning section, the log sawing section and the engine, are towed to a logging site and assembled as shown. The engine 14 is positioned with the drive line thereof in contact with right angle gear box 51 of the log sawing section 13. Likewise, log positioning section 12 is positioned adjacent to the log sawing section 13 with the upper portion of conveyors 18 adjacent to rollers 29. The appropriate drive and hydraulic connections are made and the engine started.

Logs are placed on conveyors 18 of the log positioning section 12 at the bottom portion thereof. The operator then positions himself adjacent to valves 64 or 65 depending upon the length of the logs. The control valves are next actuated to activate conveyors 18 and move the logs thereon upward along the inclined plane of the log positioning section 12.

The logs pass off the ends of conveyors 18 onto rollers 29 which allow the log to be moved forward or back before being transferred onto log bed 25 of the log sawing section 13. The spacing between the saw blades 31 and 32 is adjusted by actuating the appropriate control valves to activate hydraulic cylinders 37 and move pistons 38, yoke 39 and blade 32. In the same way, activation of cylinders 41 moves pistons 42 and guide 34 so that it is in alignment longitudinally with blade 32.

The log on bed 25 of the log sawing section 13 then is advanced toward saw blades 31 and 32 by activating chain conveyor 27 so that dog 28 thereof will push the log into contact with the saw blades. Since the saw blades 31 and 32 are disposed vertically, the blades wil cut slabs from each side of the log as it moves along the bed 25. The splitter guides 33 and 34 separate the slabs from the center portion of the log before it advances to the second saw assembly and blades 45.

The horizontally disposed saw blades 45 cut the log into the desired dimensions. Pivoting arm 43 rides along the upper surface of the log to prevent it from kicking back as it is being cut by blades 45. The cut lumber is pulled through blades 45 by outfeed rolls 47 with the aid of pressure roll 49 which is biased against the outfeed rolls. The sawdust produced by blades 31, 32 and 45 is exhausted through hood 66 and manifold 67.

Other logs are moved up the log positioning section 12 and onto the log sawing section 13 as described above and cut into lumber of the desired dimensions. Changes in the dimensions of the lumber can be achieved by changing the spacing between blades 31 and 32 or by adding additional blades (not shown) to the first sawing assembly. Likewise, the number and spacing of the blades 45 on shaft 46 may be changed to provide the desired size lumber. Similarly, the dimensions of the outer slabs may be varied in the same way. The capability of changing the spacing and number of blades both vertically and horizontally enables the operator to make the necessary adjustments of the mill to efficiently utilize logs of widely different diameters and lengths.

When all of the logs at the site have been cut into lumber, the drive 14 is disconnected from the log sawing section 13 and towed to a new site. Likewise, the log positioning section 12 is disconnected from the log sawing section and the two sections independently towed to the new site. The three sections then are positioned in proper alignment again and the drive and hydraulic connections made. Thus, in a few minutes, the sawmill of the invention set up for use simply and conveniently, is ready to beginning the sawing of logs at a new location.

The above description and the accompanying drawings show that the present invention provides a novel sawmill that can utilize logs of widely varying diameters and lengths. Further, the sawmill has the capability of sawing the logs into lumber having a variety of sizes. Also, the sawmill of the invention can complete the sawing operations in a single pass.

Another advantage of the sawmill of the invention is the complete control of the logs as they move through the mill by an operator positioned at the operating controls. Thus, one person can operate the mill without assistance. The central location of the operating controls enables the operator to make adjustments of the mill to produce different sizes of lumber from his normal work station. In addition, the sawmill of the invention is simple in design and can be fabricated from commercially available components.

It will be apparent that various modifications can be made in the particular sawmill described in detail above and shown in the drawings within the scope of the invention. For example, the arrangement and connection of the log positioning section and the log sawing section with the engine can be changed for specific requirements. Also, the size and configuration of the respective sections may modified as desired. In addition, the means for adjusting the various components can be different. Therefore, the scope of the invention is to be limited only by the following claims.

What is claimed is:

1. A portable sawmill including a log positioning section, a log sawing section and drive means for said log positioning section and said log sawing section; said log positioning section including a supporting frame with an inclined face and a conveyor means disposed along said inclined face of said supporting frame with means to engage and move logs transversely of their lengths up the inclined face, said log sawing section including an elongated substantially horizontal log bed adjacent the upper end of the inclined face of said supporting frame, first conveyor means for moving logs along said bed, a first saw assembly including at least two substantially vertical saw blades rotatably mounted on a common horizontal drive shaft disposed adjacent said log bed, means for adjusting the spacing between said substantially vertical saw blades, at least two vertically disposed guide means positioned adjacent the delivery area of said substantially vertical and aligned therewith saw blades, means for adjusting the spacing between said guide means, a second saw assembly including a plurality of substantially horizontal saw blades rotatably mounted on a common vertical drive shaft disposed adjacent to said log bed, second conveyor means for moving along said bed located adjacent the delivery area of said plurality of saw blades, and said drive means including controls for independently actuating said conveyor means of said log positioning section and said first and second conveyor means of said log sawing section; said means for adjusting the spacing between said substantially vertical saw blades including means for rotatably supporting one of said substantially vertical saw blades, said saw support means being associated with another of said substantially vertical saw blades and movable toward and away therefrom, and means for effecting movement of said saw support means.

2. A portable sawmill according to claim 1 wherein said conveyor means of said log positioning section and said first conveyor means of said log sawing section are endless chain conveyors.

3. A portable sawmill according to claim 1 wherein said second conveyor means includes at least one gripping roll rotatably mounted on a vertical drive shaft and a rotatably mounted vertical pressure roll adjacent to and biased toward said gripping roll.

4. A portable sawmill according to claim 1 wherein said log positioning section and said drive means are separable from said log sawing section and each is independently supported on its own wheeled carrier.

5. A portable sawmill according to claim 1 wherein said means for adjusting the spacing between the saw blades of said first saw assembly and the spacing between said guide means includes hydraulic cylinders and pistons.

6. A portable sawmill according to claim 5 wherein only one of said saw blades and one of said guide means are moved to change the spacing thereof.

7. A portable sawmill according to claim 1 wherein said drive means includes a direct drive system and a hydraulic system.

8. A portable sawmill according to claim 7 wherein said direct drive system includes drive lines and universal joints for said first and second saw assemblies.

9. A portable sawmill according to claim 1 including anti-kickback means adjacent said second saw assembly.

10. A portable sawmill according to claim 1 including sawdust collection means adjacent said first and second saw assemblies.

* * * * *